United States Patent [19]

Suehiro et al.

[11] Patent Number: 5,010,854

[45] Date of Patent: Apr. 30, 1991

[54] INTAKE APPARATUS FOR V-TYPE 8-CYL INTERNAL COMBUSTION ENGINE

[75] Inventors: Urabe Suehiro, Fujisawa; Honma Masayuki; Kamibeppu Tohru, both of Yokohama, all of Japan

[73] Assignee: Nissan Motor Co., Ltd., Yokohama, Japan

[21] Appl. No.: 551,367

[22] Filed: Jul. 12, 1990

[51] Int. Cl.[5] ..... F02B 75/18

[52] U.S. Cl. ..... 123/52 MV; 123/55 VE

[58] Field of Search ..... 123/52 MV, 52 M, 52 MC, 123/52 MB, 55 VE

[56] References Cited

U.S. PATENT DOCUMENTS

| | | | |
|---|---|---|---|
| 2,012,902 | 8/1935 | Barkeij | 123/55 VE |
| 2,916,027 | 12/1959 | Chayne et al. | 123/52 MV |
| 3,171,393 | 3/1965 | Platner et al. | 123/55 VE |
| 3,742,923 | 7/1973 | Oblander et al. | 123/52 MV |
| 4,641,610 | 2/1987 | Rutschmann | 123/52 MV |
| 4,932,367 | 6/1990 | Newman et al. | 123/55 VE |
| 4,932,368 | 6/1990 | Abe et al. | 123/52 MV |

FOREIGN PATENT DOCUMENTS

| | | | |
|---|---|---|---|
| 1-310118 | 12/1989 | Japan | 123/55 VE |

*Primary Examiner*—David A. Okonsky
*Attorney, Agent, or Firm*—Pennie & Edmonds

[57] ABSTRACT

To facilitate the die casting, equalize the intake pipe lengths, and reduce thermal distortion of a rather complicated intake apparatus for a V-shape 8-cylinder engine which can prevent intake interference between intake strokes of two successively operating cylinders, the intake apparatus is divided into right and left collectors (4, 5) formed with two upper bent blanch pipes (P3U, P5U, P4U, P6U), respectively; front and rear X-shaped pipe members (7, 8) formed with two crossing intake pipes (P1, P2, P7, P8), respectively; and a middle lower manifold (6) formed with four lower bent branch pipes (P3L, P5L, P4L, P6L) connected to the four upper bent blanch pipes, respectively. The four upper bent blanch pipes (P3U, P5U, P4U, P6U) extending from the right and left collectors (4, 5) are connected to the middle lower manifold (6) via a middle flange (23); four upper ends of the two X-shaped pipes (P1, P2, P7, P8) are connected to the right and left collectors via four rubber hoses (42, 43, 50, 51); the four lower bent blanch pipes (P3L, P5L, P4L, P6L) and four lower ends of the two X-shaped pipes (P1, P2, P7, P8) are connected to the cylinder heads via flanges (39, 40, 48, 49), respectively.

11 Claims, 4 Drawing Sheets

RELATED INVENTION

INTAKE APPARATUS FOR V-TYPE 8-CYL INTERNAL COMBUSTION ENGINE

RELATED APPLICATION

This application is closely related to our prior copending application for U.S. Pat. entitled "INTAKE APPARATUS FOR V-TYPE INTERNAL COMBUSTION ENGINE" which was filed on July 25, 1989 and which bears U.S. Ser. No. 07/384610, and more specifically to an improvement in structure and manufacture thereof.

BACKGROUND OF THE INVENTION

1. Field of the Invention

The present invention relates to an intake apparatus for a V-type 8-cylinder internal combustion engine, and more specifically to an intake pipe structure of the intake apparatus, which is suitable for die casting.

2. Description of the Prior Art

In prior-art intake apparatus for V-type 8-cylinder internal combustion engines, a pair of collectors are disposed over both right and left banks of an engine body, respectively as disclosed in Japanese Published Unexamined (Kokai) Utility Appli. Nos. 61-53528 and 62-49626. In the former Patent disclosure (61-53528), 8 intake pipes are arranged alternately in such a way that right-bank cylinders are connected to a left collector over a left-bank, and left-bank cylinders are connected to a right collector over a right-bank, respectively. In the later patent disclosure (62-49626), 8 U-shaped intake pipes are arranged alternately in such a way that right-bank cylinders are connected to a right collector over a right-bank (on the same side), and left-bank cylinders are connected to a left collector over a left bank (on the same side), respectively.

On the other hand, in the V-type 8-cylinder internal combustion engines with a bank angle of 90 degrees, there exists a single plane type where crankpins of a crankshaft are arranged at 180-degree angular intervals on a single plane and a double plane type where crankpins are arranged at 90-degree angular intervals on two planes. In practice, however, two-plane type engines are widely adopted on the market.

In the above-mentioned two-plane V-type 8-cylinder engines, the order of cylinder ignitions are beginning from the engine front end as follows: "1 (1st cyl)–2 (2nd cyl) –7 (7th cyl)–3 (3rd cyl)–4 (4th cyl)–5 (5th cyl)–6 8". In the prior-art engine, however, since the cylinders are simply separated and connected to the right and/or left collectors disposed over the right and/or left banks, respectively, there exists a problem in that two cylinders into which intake air is introduced successively are connected to one of the two collectors, so that it is impossible to effectively introduced intake air into each cylinder, successively.

To overcome the above-mentioned problem, the applicant has already proposed an intake apparatus for V-shaped internal combustion engine, by which two cylinders into which intake air is introduced successively are perfectly divided into two collectors, as stated hereinbefore under RELATED APPLICATION.

The intake apparatus already proposed by the same applicant and the same inventor will be described in further detail hereinbelow. In FIG. 1, a first subcollector is arranged over a first bank (not shown) along which 1st, 3rd, 5th and 7th cylinders are arranged, and a second subcollector is arranged over a second bank (not shown) along which 2nd, 4th, 6th and 8th cylinders are arranged. The 1st and 7th cylinders on the first collector side are connected to the opposite second collector via 1st and 7th intake pipes P1 and P7; the 2nd and 8th cylinders on the second collector side are connected to the first opposite collector via 2nd and 8th intake pipes P2 and P8; the 3rd and 5th cylinders on the first collector side are connected to the first same collector via U-shaped 3rd and 5th intake pipes P3 and P5; and the 4th and 6th cylinders on the second collector side are connected to the second same collector via U-shaped 4th and 6th intake pipes P4 and P6. In the intake apparatus as shown in FIG. 1, however, since the 1st and 2nd intake pipes P1 and P2 arranged on the engine front side and the 7th and 8th intake pipes P7 and P8 arranged on the engine rear side all extend from one cylinder head on one bank side to a collector arranged over the other bank side obliquely in intersectional arrangement, and additionally the other four intermediate intake pipes P3, P4, P5 and P6 extend from one cylinder head on one bank side to a collector arranged over the same bank side into U-shape in butt arrangement, there exists a problem in that it is practically impossible to cast these intake pipes integral with the first and the second collectors.

To overcome the above-mentioned problem, it may be possible to cast the intake apparatus as shown in FIG. 1 by dividing the eight intake pipes into four groups of two intake pipes formed integral with the right and left collectors and right and left cylinder heads, respectively. In this method, however, it is impossible to equalize the two pipe lengths of the first and third pipes P1 and P3, for instance by joining the two pipes on the same flange plane. In other words, since a plurality of flanges must be formed at different locations, there exists another problem in that the manufacturing process is extremely complicated.

Further, it is also possible to consider to divide eight intake pipes into upper and lower portions by a single roughly horizontal plane between the two cylinder heads. In this case, however, since the obliquely extending intake pipes (e.g. P1, P2, P7, P8) are cut off at an inclination angle with respect to each central axis of each intake pipe into an oval shape, when the cut-off pipe ends are connected by two flanges. There exists a problem in that air flow resistance increases markedly due to stepped change in cross-sectional area, when the two flange portions are a little offset or misaligned from each other because of casting or assembly error.

SUMMARY OF THE INVENTION

With these problems in mind, therefore, it is the primary object of the present invention to provide an intake apparatus for V-type 8-cylinder engine which can prevent intake interference between intake strokes of two successively operating cylinders by perfectly separating two successive cylinder intake strokes into two collectors, respectively; provide equidistant intake pipes; prevent intake pipe distortion due to thermal expansion; and minimize the number of flange joints.

To achieve the above-mentioned object, the intake apparatus, according to the present invention, for a V-type eight-cylinder engine having a cylinder block with a first bank along which first, third, fifth and seventh cylinders (#1, #3, #5, and #7) are arranged open and a second bank along which second, fourth, sixth and eight cylinders (#2, #4, #6, and #8) are arranged open, comprising: (a) a first collector (4) disposed over said first bank and formed by casting with third and fifth upper bent branch pipes (P3U, P5U); (b) a second collector (5) disposed over said second bank and formed by casting with fourth and sixth upper bent branch pipes (P4U, P6U); (c) a first X-shaped pipe member (7) disposed at first ends of the first and second banks and formed by casting with a first intake pipe (P1) connected between the first cylinder (#1) and said second collector (5) and a second intake pipe (P2) connected between the second cylinder (#2) and said first collector (4); (d) a second X-shaped pipe member (8) disposed at second ends of the first and second banks and formed by casting with a seventh intake pipe (P7) connected between the seventh cylinder (#7) and said second collector (5) and an eighth intake pipe (P8) connected between the eighth cylinder (#8) and said first collector (4); and (e) a lower manifold (6) disposed between the first and second collectors and between said first and second X-shaped pipes and formed by casting with a third lower bent branch pipe (P3L) connected between the third cylinder (#3) and the third upper bent branch pipe (P3U) into U-shape, a fifth lower bent branch pipe (P5L) connected between the fifth cylinder (#5) and the fifth upper bent branch pipe (P5U) into U-shape, a fourth lower bent branch pipe (P4L) connected between the fourth cylinder (#4) and the fourth upper bent branch pipe (P4U) into U-shape, and a sixth lower bent branch pipe (P6L) connected between the sixth cylinder (#6) and the sixth upper bent pipe (P6U) into U-shape. Further, the lower manifold (6) is further formed by casting with a middle flange (23) for connecting both the upper and lower bent branch pipes of each of the third, fifth, fourth and sixth U-shaped intake pipes (P3, P5, P4, P6), respectively on a plane perpendicular to an axis of the intake passage of each U-shaped intake pipe.

Further, the first intake pipe (Pl) of said first X-shaped pipe member (7) is connected to said second collector via a first rubber hose (42); said second intake pipe (P2) of said first X-shaped pipe (7) is connected to said first collector via a second rubber hose (43); said seventh intake pipe (P7) of said second X-shaped pipe member (8) is connected to said second collector via a third rubber hose (50); and said eighth intake pipe (P8) of said second X-shaped pipe (8) is connected to said first collector via a fourth rubber hose (51).

In the intake apparatus for a V-type 8-cylinder engine according to the present invention, since a rather complicated intake apparatus which can prevent intake interference between intake strokes of two successive cylinders is divided into five sections of right and left collectors formed with two upper bent blanch pipes, respectively; front and rear X-shaped pipes formed with two crossing intake pipes, respectively; and a middle lower manifold formed with four lower bent branch pipes connectable to the four upper bent blanch pipes, respectively, it is possible to facilitate die casting of the intake apparatus and equalize the intake pipe lengths. Further, since intake pipes of the front and rear X-shaped pipes are connected to the right and left collectors via rubber hoses, it is possible to prevent intake pipe distortion due to thermal expansion and therefore to reduce the number of flanges for connecting a plurality of intake pipes to the collectors or the cylinder heads, respectively.

BRIEF DESCRIPTION OF THE PREFERRED EMBODIMENTS

DETAILED DESCRIPTION OF THE PREFERRED EMBODIMENTS

An embodiment of the intake apparatus for a V-type 8-cylinder internal combustion engine according to the present invention will be described in detail hereinbelow with reference to FIGS. 2 to 4.

Figure 3:
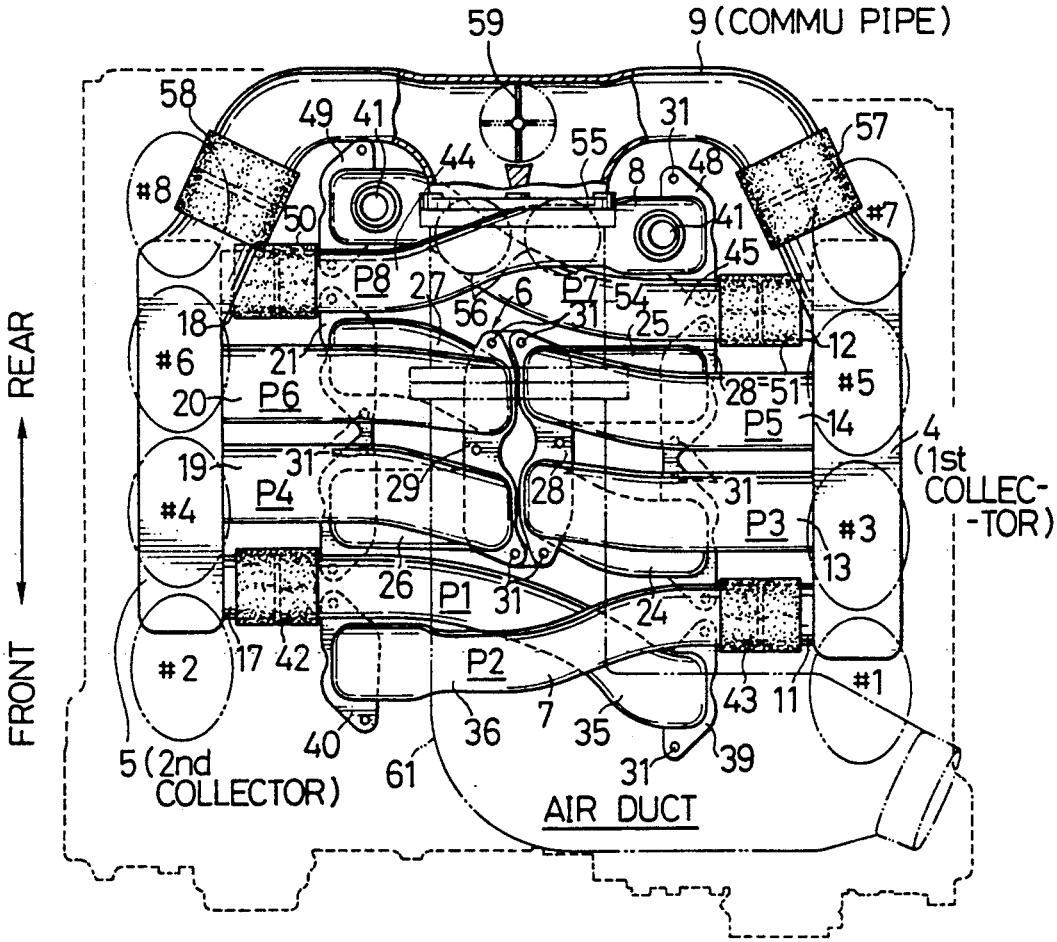
FIG. 3 is a top view showing the same intake apparatus shown in FIG. 2.
Figure 4:
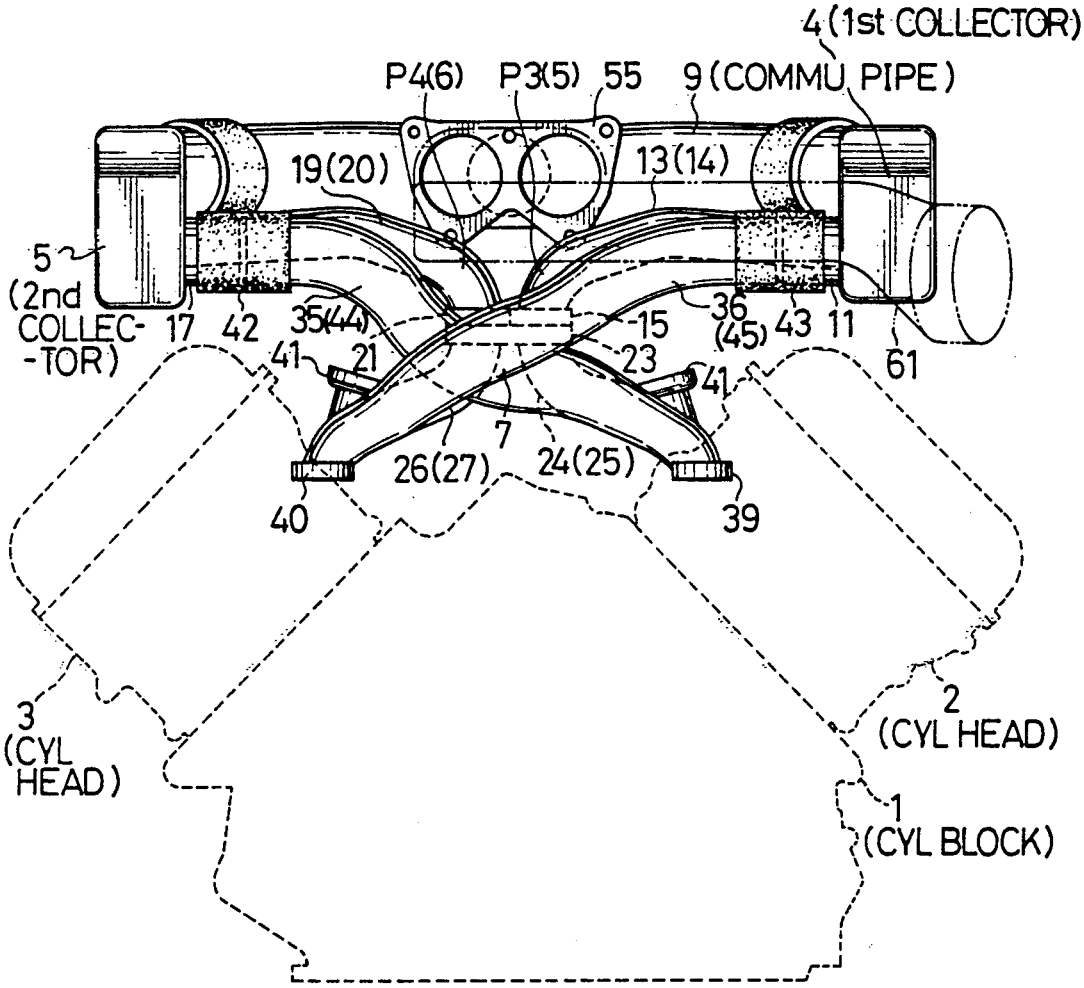
FIG. 4 is a front view showing the same intake apparatus shown in FIG. 3.

In FIG. 4, an engine is formed with a cylinder block 1 and a pair of cylinder heads 2 and 3 mounted on two banks (sloped surfaces) of the cylinder block 1 with a bank angle of 90 degrees. Further, 8 intake ports (not shown) are formed open on two inside surfaces of the cylinder heads 2 and 3. The eight cylinders from 1st (#1) to 8th (#8) are formed being arranged in the order of #1, #3, #5 and #7 along the right cylinder head 2 (in FIG. 4) beginning from the engine front side (in FIGS. 2 and 3) and in the order of #2, #4, #6 and #8 along the left cylinder head 3 beginning from the engine front side.

Figure 1:
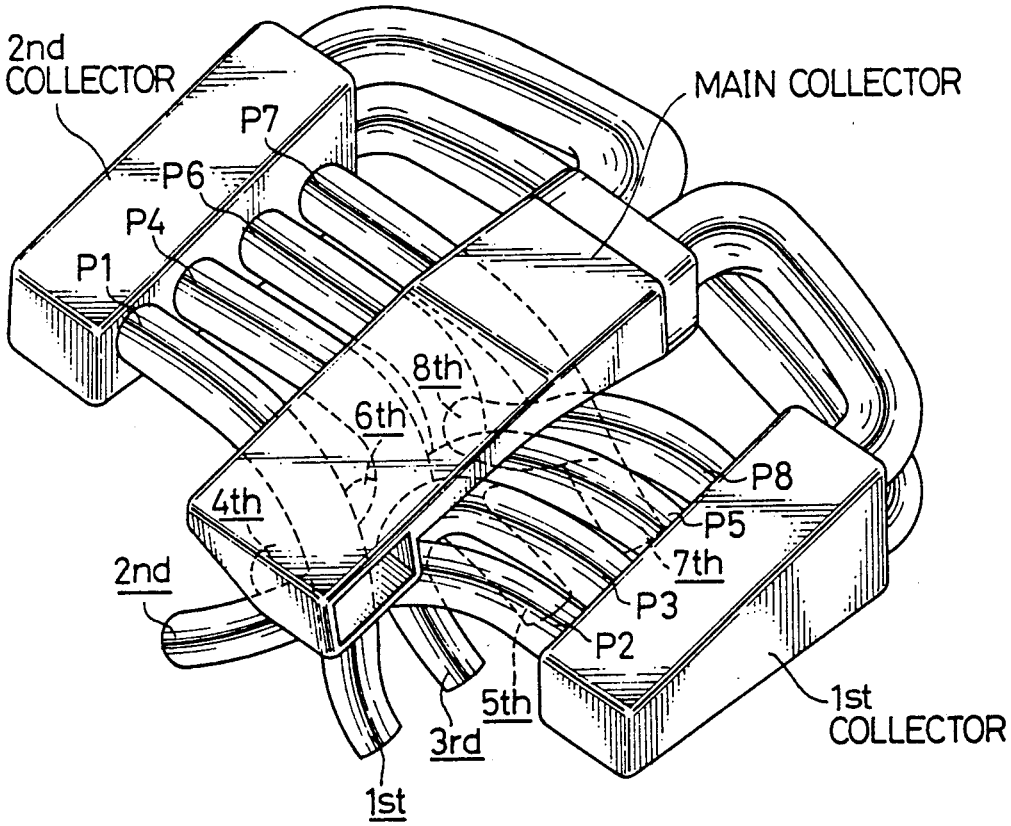
FIG. 1 is a diagrammatical perspective view showing an intake apparatus for a V-type 8-cylinder internal combustion engine, related to the intake apparatus according to the present invention.
Figure 2:
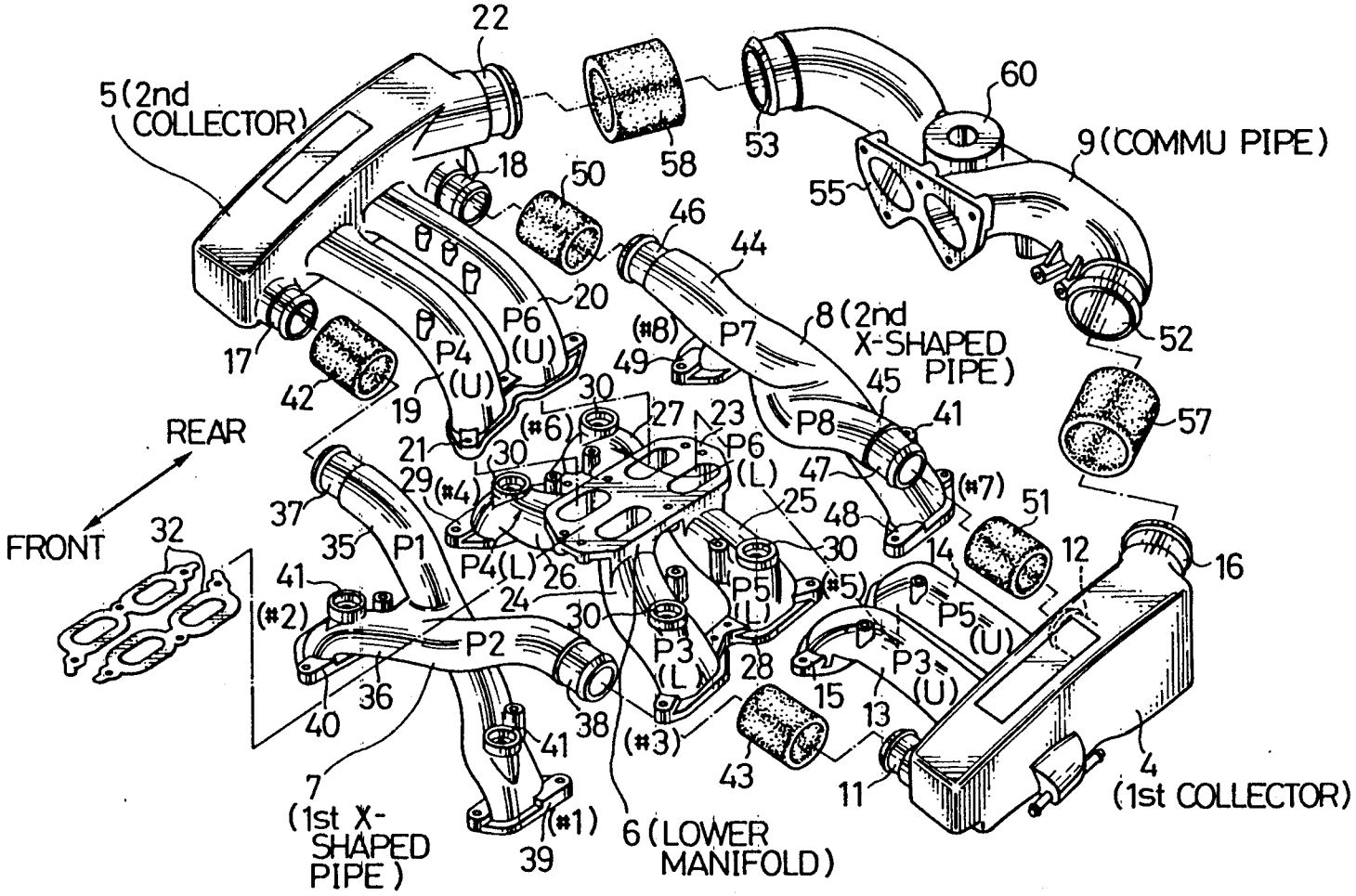
FIG. 2 is an exploded view showing one embodiment of the intake apparatus for a V-type 8-cylinder internal combustion engine according to the present invention.

As shown in FIG. 2, the intake apparatus roughly comprises a first collector 4, a second collector 5, a lower manifold 6, a first X-shaped pipe member 7, a second X-shaped pipe member 8, and a communication pipe member 9, which are all manufactured by aluminium alloy die casting, separately.

The first collector 4 is arranged over the cylinder head 2 as shown in FIG. 4 into a long box-shape, and formed by casting integral with two relatively short hose connecting cylindrical portions 11 and 12 extending from both ends on the inner surface thereof, a pair of relatively long upper bent branch pipes 13 (P3U) and 14 (P5U) extending from the middle on the inner surface thereof, and an intake air inlet port 16 extending obliquely from a rear corner thereof.

Each of the above two upper bent branch pipes 13 and 14 is formed so as to be curved downwardly and with a common flange 15 at each free end thereof.

Therefore, each of the two branch pipes 13 and 14 extending from the first collector 4 forms an upper half portion P3(U) or P5(U) of each of 3rd and 5th intake pipes P3 and P5 communicating with the 3rd and 5th cylinders #3 and #5 arranged open to the right bank (FIGS. 3 and 4) of the cylinder block 1.

The second collector 5 is arranged over the cylinder head 3 as shown in FIG. 4 into a long box-shape, and formed by casting integral with two relatively short hose connecting cylindrical portions 17 and 18 extending from both ends on the inner surface thereof, a pair of relatively long upper bent branch pipes 19(P4U) and 20(P6U) extending from the middle on the inner surface thereof, and an intake air inlet port 22 extending obliquely from a rear corner thereof, in symmetrical positional relationship with respect to the first collector 4.

Each of the above two upper bent branch pipes 19 and 20 is formed so as to be curved downwardly and with a common flange 21 at each free end thereof.

Therefore, each of the two branch pipes 19 and 20 extending from the second collector 5 forms an upper half portion P4(U) or P6(U) of each of the 4th and 6th intake pipes P4 and P6 communicating with the 4th and 6th cylinders #4 and #6 arranged open to the left bank (FIGS. 3 and 4) of the cylinder block 1.

The lower manifold 6 is formed with a relatively large middle flange 23 and with four lower bent branch pipes 24(P3L), 25(P5L), 26(P4L) and 27(P6L) extending from the middle flange 23 by casting. Each of the two lower bent branch pipes 24 and 25 is formed so as to be curved upwardly toward the first collector 4, and connected to a common flange 28 at the end thereof. Therefore, each of the two branch pipes 24 and 25 extending from the middle flange 23 forms a lower half portion P3(L) and P5(L) of each of the 3rd and 5th intake pipes P3 and P5 communicating with the 3rd and 5th cylinders #3 and #5. Further, a boss 30 for mounting a fuel injection valve is formed on the upper outer surface of each of these two lower bent branch pipes 24 and 25.

Each of the two lower bent branch pipes 26 and 27 is formed so as to be curved upwardly toward the second collector 5, and connected to a common flange 29. Therefore, each of the two branch pipes 26 and 27 extending from the middle flange 23 forms a lower half portion P4(L) and P6(L) of each of the 4th and 6th intake pipes P4 and P6 communicating with the 4th and 6th cylinders #4 and #6. Further, the similar boss 30 for mounting 4 fuel injection valve is formed on the upper outer surface of each of these two lower bent branch pipes 26 and 27.

The middle flange 23 of the lower manifold 6 is connected to the four upper bent branch pipes 13, 14, 19 and 20 of the two collectors 4 and 5 via the two flanges 15 and 21 with bolts 31 (shown in FIG. 3) with two gaskets 32 (shown in FIG. 2) disposed between these flanges so as to from four U-shaped branch pipes P3, P5, P4 and P6 in an X-shaped fashion. Further, the common flange 28 is fixed to the inside surface of the cylinder head 2 under the first collector 4 in such a way that the pipes 24 and 25 are fixed to intake ports of the third and fifth cylinders #3 and #5 open to the cylinder head 2. The common flange 29 is also fixed to the inside surface of the cylinder head 3 under the second collector 5 with plural bolts 31 (shown in FIG. 3) in such a way that the pipes 19 and 20 are fixed to intake ports of the fourth and sixth cylinders #4 and #6 open to the cylinder head 3.

Therefore, a third U-shaped intake pipe P3 can be formed by the upper and lower bent branch pipes 13(P3U) and 24(P3L); a fifth U-shaped intake pipe P5 can be formed by the upper and lower bent branch pipes 14(P5U) and 25(P5L); a fourth U-shaped intake pipe P4 can be formed by the upper and lower bent branch pipes 19(P4U) and 26(P4L) and a sixth U-shaped intake pipe P6 can be formed by the upper and lower bent branch pipes 20(P6U) and 27(P6L), as depicted in FIG. 4.

Further, the middle flange 23 of the lower manifold 6 is fixed to the two common flanges 15 and 21 of these four upper bent branch pipes 13, 14, 19 and 20 on a plane perpendicular to an axis of the intake passage of each U-shaped intake pipe P3, P5, P4 or P6.

On the other hand, the first X-shaped pipe member 7 arranged on the engine front side is formed with a first intake pipe 35 (P1) and a second intake pipe 36(P2) in intersectional relationship with respect to each other by casting. A cylindrical hose connecting end 37 or 38 is formed at an upper end of each of these intake pipes 35 and 36; an end flange 39 or 40 is formed at a lower end thereof; and a fuel injection valve mounting boss 41 is also formed on the outer surface just over the flange 39 or 40. Further, the intake pipes 35 and 36 do not communicate with each other; that is, the intake pipes 35 and 36 constitute two (1st and 2nd) independent intake pipes P1 and P2, respectively.

The flange 39 of the pipe 35 is fixed to an intake port of the first cylinder #1 open to the cylinder head 2 under the first collector 4 with bolts 31, and the flange 40 of the pipe 36 is fixed to an intake port of the second cylinder #2 open to the cylinder head 3 under the second collector 5 with bolts 31. Further, the hose connecting end 37 of the pipe 35 is connected to the hose connecting cylinder portion 17 of the second collector 5 via a rubber hose 42, and the hose connecting end 38 of the pipe 36 is connected to the hose connecting cylindrical portion 11 of the first collector 4 via a rubber hose 43.

The second X-shaped pipe member 8 arranged on the engine rear side is formed with seventh intake pipe 44(P7) and an eighth intake pipe 45(P8) in intersectional relationship with respect to each other by casting. A cylindrical hose connecting end 46 or 47 is formed at an upper end of each of these intake pipes 44 and 45; an end flange 48 or 49 is formed at a lower end thereof; and a fuel injection valve mounting boss 41 is also formed on the outer surface just over the flange 48 and 49. Further, the intake pipes 44 and 45 do not communicate with each other; that is, the intake pipes 44 and 45 constitute two (7th and 8th) independent intake pipes P7 and P8, respectively.

The flange 48 of the pipe 44 is fixed to an intake port of the seventh cylinder #7 open to the cylinder head 2 under the first collector 4 with bolts 31, and the flange 49 of the pipe 45 is fixed to an intake port of the eighth cylinder #8 open to the cylinder head 3 under the second collector 5 with bolts 31. Further, the hose connecting end 46 of the pipe 44 is connected to the hose connecting cylindrical portion 18 of the second collector 5 via a rubber hose 50, and the hose connecting end 47 of the pipe 45 is connected to the hose connecting cylindrical portion 12 of the first collector 4 via a rubber hose 51 with bolts 31.

The communication pipe 9 is formed with a middle flange 55 fixed to a throttle chamber 54 (shown in FIG. 3) and two gently curved both side intake air outlets 52 and 53 connected to the intake air inlet portions 16 and 22 of the first and second collectors 4 and 5 via two rubber hoses 57 and 58, respectively. Each of two apertures formed in the middle flange 55 communicates with each of the two intake air outlets 52 and 53. Further, a pair of throttle valves 56 (shown in FIG. 3) closed or opened simultaneously are arranged in this middle throttle chamber 54. Therefore, intake air introduced through the two throttle valves 56 is passed through the two passages of the communication pipe 9 to the first and second collectors 4 and 5 independently from each other. However, since an intake switch valve 59 is disposed at the middle of the communication pipe 9 as shown in FIG. 3, when this switch valve 59 is kept open as shown by dashed lines in FIG. 3, the first and second collectors 4 and 5 communicate with each other. Further, the above switch valve 59 is driven by a motor (not shown) mounted within a middle cylindrical boss 60 (shown in FIG. 2) of the communication pipe 9.

With reference to FIG. 3, since the middle flange 55 of the communication pipe 9 is formed facing toward the engine front, the throttle chamber 54 connected to this flange 55 is formed over the second X-shaped pipe member 8 and further an intake air duct 61 connected to the throttle chamber 54 extends over the lower manifold 6 and the first X-shaped pipe member 7 within a space between the two collectors 4 and 5. The intake air duct 61 is bent at the engine front as shown in FIG. 3.

In the above-mentioned intake pipe arrangement, the first and seventh cylinders #1 and #7 formed under the first collector 4 communicate with the second collector 5 via the two curved pipes P1 and P7. In contrast with this, the third and fifth cylinders #3 and #5 formed under the first collector 4 communicate with the same first collector 4 via the two U-shaped pipes P3 and P5, respectively. Similarly, the second and eighth cylinders #2 and #8 formed under the second collector 5 communicate with the first collector 4 via the two curved pipes P2 and P8. In contrast, fourth and sixth cylinders #4 and #6 formed under the second collector 5 communicate with the same second collector 5 via the two U-shaped pipes P4 and P6, respectively.

Therefore, when the cylinders are ignited in the order of "1-2-7-3-4-5-6-8" or "1-5-6-3-4-2 -7-8", it is possible to perfectly divide two cylinders of two successive intake strokes into the two collectors 4 and 5, that is, to prevent intake air interference between two intake strokes of two successively operating cylinders.

Further, in the intake apparatus according to the present invention, since the two collectors 4 and 5, the two X-shaped pipe members 7 and 8, and a lower manifold 6 are all casted separately from each other, it is possible to freely determine each intake pipe length under equidistant condition. In practice, it is possible to easily determine pipe lengths (P1, P2, P7, P8) of the curved pipes 35, 36, 44 and 45 of the two X-shaped pipe members 7 and 8 to be equal to these (P3, P4, P5, P6) of the U-shaped pipes 13 and 24, 14 and 25, 19 and 26 and 20 and 27, so that it is possible to obtain the equidistant intake pipes, prevent the intake air interference, increase the dynamic intake effect, and reduce the difference in the amount of intake air introduced into each cylinder.

Further, although the first and second collectors 4 and 5 are fixed to the lower manifold 6 via the middle flange 23 of the manifold 6, since the first and second X-shaped pipe members 7 and 8 are connected to the first and second collectors 4 and 5 via four rubber hoses 42, 43, 50 and 51, it is possible to effectively absorb distortion in various direction due to casting error, thermal expansion, etc., so that it is possible to prevent the loosenness of the sealing members and bolts at the various flange portions.

As described above, since the intake pipes according to the present invention are fixed via flanges at positions where a relatively large mechanical strength is required and via the hoses at positions where a relatively small mechanical strength is required, in combination with flange connection and hose connection, it is possible to reduce the size and the number of the flanges for providing a smaller and light-weight intake apparatus as a whole.

In addition, since the four middle intake pipes P3, P4, P5 and P6 are each divided into the upper portions P3U, P4U, P5U and P6U extending from the first and second collectors 4 and 5 and the lower portions P3L, P4L, P5L and P6L extending from the lower manifold 6 along a roughly horizontal surface of the middle flange 23, the casting process can be facilitated; the number of flange surfaces to be machined can be minimized; and the two junction surfaces can be connected accurately without producing stepped cross-section junction due to an offset or misalignment between the middle flange 23 and the two end flanges 15 and 21, because the split flange surface is perpendicular to the axis of the intake air passage within the intake pipes P3 to P6.

As described above, in the intake apparatus for a V-type 8-cylinder engine according to the present invention, since a plurality of complicated intake pipes are divided into two X-shaped pipe members 7 and 8 composed of two slightly curved intake pipes P1, P2, P7 and P8 so as to extend from one collector disposed over one cylinder head on one bank side to the cylinders arranged along the other cylinder head on the other bank side or vice versa, and further into four U-shaped pipes P3, P4, P5 and P6 composed of the upper and lower branch pipes 13, 14, 19 and 20 and 24, 25, 26 and 27 connected by the middle flange 23 so as to extend from one collector disposed over one cylinder head on one bank side to the cylinders arranged along the same cylinder head on the same bank side, it is possible to cast a complicated intake apparatus by a simple process, prevent intake air interference between two successively operating cylinders by perfectly separating the two successive cylinder intake strokes into the two collectors. Further it is also possible to equalize the lengths of the intake pipes to each other, prevent distortion due to thermal expansion or dimensional difference, and reduce the size and weight of the intake apparatus, because the number of flange junction points is small.

What is claimed is:

1. An intake apparatus for a V-type eight-cylinder engine having a cylinder block with a first bank along which first, third, fifth and seventh cylinders are arranged open and a second bank along which second, fourth, sixth and eight cylinders are arranged open, comprising:

(a) a first collector disposed over said first bank an formed by casting with third and fifth upper bent branch pipes;

(b) a second collector disposed over said second bank and formed by casting with fourth and sixth upper bent branch pipes;

(c) a first X-shaped pipe member disposed at first ends of the first and second banks and formed by casting with a first intake pipe connected between the first cylinder and said second collector and a second intake pipe connected between the second cylinder and said first collector;

(d) a second X-shaped pipe member disposed at second ends of the first and second banks and formed by casting with a seventh intake pipe connected between the seventh cylinder and said second collector and an eighth intake pipe connected between the eighth cylinder and said first collector; and (e) a lower manifold (6) disposed between the first and second collectors and between said first and second X-shaped pipes and formed by casting with a third lower bent branch pipe connected between the third cylinder and the third upper bent branch pipe into U-shape, a fifth lower bent branch pipe connected between the fifth cylinder and the fifth upper bent branch pipe into U-shape, a fourth lower bent branch pipe connected between the fourth cylinder and the fourth upper bent branch pipe into U-shape, and a sixth lower bent branch pipe connected between the sixth cylinder and the sixth upper bent pipe into U-shape.

2. The intake apparatus of claim 1, wherein said lower manifold is further formed by casting with a middle flange for connecting both the upper and lower bent branch pipes of each of the third, fifth, fourth and sixth U-shaped intake pipes, respectively on a plane perpendicular to an axis of the intake passage of each U-shaped intake pipe.

3. The intake apparatus of claim 2, wherein said third and fifth upper bent branch pipes extending from said first collector are further formed with a first common flange connected to said middle flange of said lower manifold.

4. The intake apparatus of claim 3, wherein said fourth and sixth upper bent branch pipes extending from said second collector are further formed with a second common flange connected to said middle flange of said lower manifold.

5. The intake apparatus of claim 4, wherein said first and second common flanges are connected to said middle flange of said lower manifold via a gasket.

6. The intake apparatus of claim 1, wherein said third and fifth lower bent branch pipes are formed with a third common flange connected to intake ports of the third and fifth cylinders open to the first bank.

7. The intake apparatus of claim 1, wherein said fourth and sixth lower bent branch pipes are formed with a fourth common flange connected to intake ports of the fourth and sixth cylinders open to the second bank.

8. The intake apparatus of claim 1, wherein each of said first, second, seventh and eighth intake pipes is formed with a flange connected to an intake port of each of the first and seventh cylinders open to the first bank and to an intake port of each of the second and eighth cylinders open to the second bank, respectively.

9. The intake apparatus of claim 1, wherein said first intake pipe of said first X-shaped pipe member is connected to said second collector via a first rubber hose; said second intake pipe of said first X-shaped pipe is connected to said first collector via a second rubber hose; said seventh intake pipe of said second X-shaped pipe member is connected to said second collector via a third rubber hose; and said eighth intake pipe of said second X-shaped pipe is connected to said first collector via a fourth rubber hose.

10. The intake apparatus of claim 1, which further comprises a communication pipe member connected to a throttle chamber at a middle thereof and to said first and second collectors at both ends thereof via two rubber hoses, respectively.

11. The intake apparatus of claim 1, wherein each of said eight intake pipes is formed with a fuel injection valve mounting boss, respectively.

* * * * *